United States Patent [19]

Kato et al.

[11] 4,036,721

[45] July 19, 1977

[54] METHOD FOR COATING A CONDUCTIVE MATERIAL

[75] Inventors: Hisao Kato, Neyagawa; Hideo Yagi, Kyoto; Shunji Fukuta, Takatsuki, all of Japan

[73] Assignee: Nippon Paint Co., Ltd., Osaka, Japan

[21] Appl. No.: 690,046

[22] Filed: May 25, 1976

Related U.S. Application Data

[63] Continuation-in-part of Ser. No. 486,834, July 9, 1974, Pat. No. 3,988,231.

[51] Int. Cl.[2] ..... C25D 13/20

[52] U.S. Cl. ..... 204/181

[58] Field of Search ..... 204/181

[56] References Cited

U.S. PATENT DOCUMENTS 3,616,392 10/1971 Hanly ..... 204/181

3,945,899 3/1976 Nikaido et al. ..... 204/181

OTHER PUBLICATIONS

Yeates, Electropainting, 1970, pp. 132–135.

*Primary Examiner*—Howard S. Williams

*Attorney, Agent, or Firm*—Wenderoth, Lind & Ponack

[57] ABSTRACT

A method for coating a conductive material, which comprises applying an inorganic composition containing at least monobasic aluminum phosphate to the conductive material to form an inorganic coating layer and then applying thereto an electrodepositable composition by electrophoretic means to form an organic coating layer. The resulting composite coating layer produced by this method is characterized by possessing excellent properties, such as excellent inter-coat adhesion, excellent corrosion resistance, impact strength and flexibility.

16 Claims, No Drawings

METHOD FOR COATING A CONDUCTIVE MATERIAL

This is a Continuation-in-part application of U.S. Ser. No. 486,834, filed on July 9, 1974, now U.S. Pat. No. 3,988,231.

The present invention relates to a method for coating a conductive material. More particularly, it relates to a method for coating a conductive material comprising applying an inorganic paint composition to the conductive material and then applying thereto a conventional electrodeposition coating.

There has, hitherto, been widely used as a coating composition a paint wherein the base material comprises mainly a resin, and various paints and coating methods are known in accordance with the various uses. Recently, an inorganic paint composition has been developed which can impart favorable properties to the coated product such as incombustibility, heat resistance, hardness or the like which can not be given by an organic paint.

An organic paint is known to possess weak heat resistance, whereas, an inorganic paint is characterized by being brittle and has remarkably inferior flexibility and impact strength. Accordingly, it has been proposed to laminate the organic coating layer with an inorganic coating layer for combining both characteristics. However, such method has not been practically used because when the inorganic and organic coating layers are laminated by a conventional method, the adhesion thereof is not enough.

Under these circumstances, the present inventors have intensively studied to discover an improved method for obtaining a laminated coating layer having both the excellent properties of durability of the inorganic coating layer and flexibility of the organic coating layer.

Generally, it is considered that it is difficult to apply an electrodeposition coating to a coating layer formed on a conductive material, but according to the present invention, it has been found that an electrodeposition coating can be applied to an inorganic coating layer having even 50 $\mu$ or more in thickness, and further that the composite coating layer of the inorganic and organic coating layers obtained by such electrodeposition coating has excellent adhesion which could not be obtained by a conventional spray coating, brushing or the like.

The present invention provides a method for coating a conductive material which comprises applying an inorganic composition containing at least one of a silicic acid base material and a metal phosphate to the conductive material to form an inorganic coating layer and then applying thereto an electrodepositable composition by electrophoretic means to form an organic coating layer.

Although it is well known that an electrodeposition coating may be applied to a coating film which is made electroconductive, the electrodeposition coating in the present invention is based on an entirely different principle from that of the conventional electrodeposition coating method because the inorganic coating layer has usually no electroconductivity. Generally, an organic coating layer is non-conductive and therefore the electrodeposition coating can not be applied thereto. On the other hand, an inorganic coating layer is more porous and hydrophilic in comparison with an organic coating layer, and therefore, when it is dipped in a water-soluble electrodepositable paint composition, water penetrates into the inorganic coating layer, and as the result, the electricity can be passed through the inorganic coating layer. This is the principle of the present electrodeposition coating.

It is known that, when an inorganic coating layer is hardened at a comparatively low temperature without melting, it is generally more porous in comparison with an organic coating layer, and therefore, even if the starting material for the inorganic coating has anticorrosive properties, the inorganic coating layer does not have enough corrosion resistance and much rusting occurs when it is tested by salt spraying tests. On the contrary, according to the present method, the obtained composite coating layer has excellent corrosion resistance according to the synergistic effect of the inorganic coating layer and the organic coating layer.

The inorganic composition used in the present invention contains at least one member selected from a silicic acid base material and a metal phosphate as the base. The preferred examples of the silicic acid base material may be an alkali metal silicate, quaternary ammonium silicate, colloidal silica, a modified silicate which is obtained by modifying an alkali metal silicate with a metal ion, or the like. The alkali metal silicate includes all conventional ones and the representative ones may be lithium silicate having the molar ratio of $SiO_2 : Li_2O$ of 3.5 to 20, sodium silicate having the molar ratio of $SiO_2 : Na_2O$ of 1.5 to 4.0 and potassium silicate having the molar ratio of $SiO_2 : K_2O$ of 1.5 to 4.0 The quaternary ammonium silicate may be prepared, for example, by passing through an aqueous solution of an alkali metal silicate and a water-soluble amine into an ion exchange resin. The colloidal silica means a colloidal silica sol stabilized with an acid or alkali. These silicic acid base materials may be used alone or in a mixture of two or more kinds thereof.

The metal phosphate used in the present invention includes a monobasic phosphate of di- or more valent metal, such as monobasic magnesium phosphate, monobasic zinc phosphate, monobasic calcium phosphate or monobasic aluminum phosphate; a sesqui, secondary or tertiary salt of the metal phosphate as mentioned above; a polyphosphate which can be prepared by heat treatment of the metal phosphate as mentioned above; or a conventional calcined metal phosphate, which can be used alone or together thereof. The polyphosphate may be preferably the one which is prepared by heating a monobasic metal phosphate at 150° to 900° C. The polyphosphate is usually not a single compound but a mixed composition, and therefore, the chemical structure thereof is hardly made clear, but according to X-ray diffraction, some polyphosphates have a peculiar diffraction angle. As the commercial product of the polyphosphate, there are HB Hardner (a trade name of Farbwerke Hoechst A.G.) and K-substance (made by Teikoku Kako K.K.). As the commercial product of the calcined metal phosphate, there is Silica Phosphate (Corrosinon SPO-28, trade name of Mizusawa Chemical Co.). Among these metal phosphates, the monobasic aluminum phosphate is the most preferred phosphate.

The silicic acid base material and the metal phosphate may be used alone or in combination thereof as the base. The preferred examples of the combination may be a mixture of acid colloidal silica and a monobasic metal phosphate, or a mixture of a cyclic polyphosphate and an alkali metal silicate.

The inorganic material as above-listed or a mixture of two or more kinds thereof is optionally mixed with a conventional coloring pigment or loading pigment (e.g. titanium oxide, red iron oxide, zinc oxide, kaolin, clay, or talc) and then the mixture is dispersed into a diluent (e.g. water) by a conventional method by using ball mill or high speed agitator to give the desired inorganic composition. To the inorganic composition may be optionally added a surface active agent, a hardening accelerator, or an organic resin. As the hardening accelerator, there may be a silicofluoride, a silicoborate, a metal oxide, or the like.

The coating amount of the inorganic composition may vary with the kinds and the contents of the solid components. For instance, when the inorganic composition consists essentially of monobasic aluminum phosphate and at least one of other metal phosphates and a diluent, it is usually coated in an amount of 0.5 to 15 $g/m^2$, preferably 1 to 8 $g/m^2$, as a solid component. When the inorganic composition consists essentially of monobasic aluminum phosphate, at least one of other metal phosphates, other additives, such as a pigment, powdery or colloidal silica, or the like, as mentioned above, and a diluent, or when the inorganic composition consists essentially of monobasic aluminum phosphate and other additives and a diluent, it is usually coated in an amount of 1 to 80 $g/m^2$, preferably 5 to 50 $g/m^2$, more preferably 10 to 30 $g/m^2$, as a solid component. When the other additives as mentioned above are admixed, they are used in an amount of 20 to 85% by weight, preferably 60 to 75% by weight on the basis of whole weight of the solid components.

The electrodepositable composition used in the present invention includes various conventional compositions. The electrodepositable composition may be generally classified into an anionic electrodepositable composition and a cationic electrodepositable composition.

The resin used for the anionic composition may be, for example, a reaction product of an aliphatic ester and an $\alpha,\beta$-unsaturated dicarboxylic acid or its anhydride. The aliphatic ester includes derivatives of drying oil, semidrying oil, tall oil or the like, and may be, for example, a modified aliphatic ester resin incorporated with an unsaturated monomer (e.g. styrene, butadiene, vinyltoluene or methyl methacrylate); an alkyl resin prepared utilizing drying or semidrying oil; an ester of an epoxy compound (e.g. Epikote 828, Epikote 1001, or Epikote 1004; each trade name of Shell International Research Mant). with an aliphatic acid (e.g. linseed oil fatty acid, Chinese tung oil fatty acid, cotton seed oil fatty acid, dehydrated castor oil fatty acid, or tall oil fatty acid) or an ester of a polyol compound (e.g. ethylene glycol, 1,2-propylene glycol, 1,4-butanediol, diethylene glycol, neopentyl glycol, or trimethylolpropane) or a resinous polyol (e.g. an allyl alcohol homopolymer, or a copolymer of allyl alcohol with an ethylenically unsaturated monomer such as styrene) with an aliphatic acid. The aliphatic ester is reacted with an $\alpha,\beta$-unsaturated dicarboxylic acid or its anhydride (e.g. maleic acid, maleic anhydride, itaconic acid, or itaconic anhydride) to give the desired resin.

Other suitable resins may be prepared by reacting the reaction product of an aliphatic ester and an $\alpha,\beta$-unsaturated dicarboxylic acid or its anhydride as mentioned above with a polyol (e.g. ethylene glycol, diethylene glycol, 2,2-bis(4-hydroxycyclohexyl)propane, or trimethylolpropane), or by reacting a resinous material having a hydroxy group or an oxirane ring (e.g. an allyl alcohol-styrene copolymer having a molecular weight of 500 to 5,000, glycidyl methacrylate, or methyl methyacrylate-n-butyl acrylate copolymer), with an aliphatic acid (e.g. linseed oil fatty acid, Chinese tung oil fatty acid, cotton seed oil fatty acid, dehydrated castor oil fatty acid, or tall oil fatty acid) and then reacting the remaining hydroxy group with an unsaturated dicarboxylic acid or its anhydride (e.g. maleic acid, maleic anhydride, itaconic acid, or itaconic anhydride). As further useful resins there may be mentioned mixed resin compositions which comprises a copolymer resin comprising a hydroxyalkyl ester of an unsaturated carboxylic acid (e.g. 2-hydroxyethyl methacrylate, or 2-hydroxy-n-propyl acrylate), an unsaturated carboxylic acid (e.g. acrylic acid, or methacrylic acid), and an ethylenically unsaturated monomer (e.g. styrene, vinyltoluene, ethyl acrylate, n-butyl acrylate, methyl methacrylate, n-butyl methacrylate, acrylonitrile, or vinyl acetate), and an amine-aldehyde condensation product. The amine-aldehyde condensation product includes a condensation product of formalin with melamine, benzoguanamine or urea, or the analogous product thereof, which may be preferably etherified with an alcohol. Moreover, there may be used a mixed resin comprising the alkyd resin having a comparatively high acid value and the amine-aldehyde condensation product.

For the preparation of the anionic electrodepositable compositions from the above-listed resins, it may be first made water-soluble by neutralizing the carboxyl group contained therein. The neutralizing agent therefor may be an inorganic base such as potassium hydroxide or ammonia, or an organic base such as amines (e.g. methylamine, ethylamine, or dimethylamine, triethylamine, morpholine, ethanolamine, methylethanolamine, or ethylenetriamine), which may be used alone or in a mixture thereof. After neutralizing the resin, to the resulting mixture may be optionally added various pigments, dispersing agents or the like, and the mixture thus obtained is then diluted with tap water or deionized water to give the desired electrodepositable composition.

The electrodepositable vehicle, i.e. the resins used for the preparation of the anionic composition, may contain a mineral acid (e.g. phosphoric acid or sulfonic acid) as well as the above carboxylic acid.

Besides, as the resin used for the cationic electrodepositable composition, there may be used a cationic resin material which is solubilized by an acid, for example, a reaction product of an epoxy compound (e.g. Epikote 836, trade name of Shell International Research Mant.) with an amine salt (e.g. a reaction product of an alcohol amine, lactic acid, boric acid and glycol) as disclosed in Japanese Patent Opening No. 13432/1972. There may be also used a resin containing a quaternary amine salt residue (e.g. a solution of a copolymer of aminoethyl methacrylate and an ethylenically unsaturated monomer which is neutralized with acetic acid). These resins may be admixed with a pigment and other various additives as like as the anionic composition to give the desired electrodepositable composition.

The substrate to be coated by the present method may be a conductive material, such as a metal (e.g. iron, copper, zinc or aluminum) or a topcoated metal, or further a material made electrically conductive by coating a metal or other conductive material by plating or deposition, or by adding a filler such as a powdery metal or graphite.

According to the present method, the inorganic composition as mentioned above is applied to the conductive material to be coated by a coating method such as spray coating, brushing, dipping, electrodeposition coating or the like and drying it at room temperature or baking it to form an inorganic coating layer. The coated substrate having the inorganic coating layer is then dipped in a bath containing the electrodepositable composition as mentioned above, wherein when an anionic composition is used, the substrate is employed as the anode, and when a cationic composition is used, the substrate is employed as the cathode, and therein electric current is passed at an applied voltage of 10 to 500 volts for 1 second to 10 minutes to form an organic coating layer.

In the electrodeposition process, the inorganic coating layer may be to have water resistance so that it is not injured during the electrodeposition process. The substrate coated by the electrodeposition is then dried as it is or preferably after rinsed with water.

As described hereinbefore, when the inorganic coating layer is applied to the inorganic coating layer or the inorganic coating layer is applied to the organic layer by the usual method, the adhesion between the both layers is generally not enough, but according to the present method, the product has excellent adhesion. According to the microscope investigation, the electrodeposited organic coating layer is tightly put into the uneven surface and the pores of the inorganic coating layer, which shows enough anchoring effect, to give the desired composite coating layer. Besides, according to the conventional electrodeposition coating, the thickness of the coating layer is at the most about 30 $\mu$, but according to the present method, the electrodeposition can be applied to the usual inorganic coating layer and thereby it can give a thick coating layer which has similar or superior properties to those of a conventional electrodeposition coating.

According to the present invention, there can be obtained a composite coating layer having significantly excellent properties as mentioned below by the combination of the inorganic coating layer and the electrodeposition coating layer.

1. The present composite coating layer has superior corrosion resistance to that obtained by the conventional electrodeposition coating which is applied to a steel panel subjected to the chemical treatment with zinc phosphate, because it has both rust inhibitory effects owing to the starting material of the inorganic composition, i.e. the silicic acid base material and the metal phosphate, and the electrodeposition coating has excellent adhesion to the inorganic coating.

2. The defect of the inorganic coating layer, i.e. the brittleness is covered by the electrodeposition coating and thereby the composite coating layer has improved impact strength and flexibility.

3. The conventional electrodeposition has a defect in that when the substrate to be coated is a metal, particularly iron, the iron ion is eluted out into the electrodeposition coating, which results in coloring of the coating layer. On the other hand, according to the present invention, the amount of the eluted iron ion is extremely low in comparison with that obtained by the conventional electrodeposition coating which is applied to a steel panel subjected to the chemical treatment with zinc phosphate. Thus, the present method can give a purely white coating layer without the defect of coloring and having excellent corrosion resistance even in the case of a white-colored electrodeposition coating.

4. Since the inorganic coating layer has excellent heat resistance and incombustibility, even after the upper organic coating layer (electrodeposition coating layer) is destroyed under a severe heat condition, the substrate is still protected by the inorganic coating layer.

5. The present product may be optionally top-coated by conventional various paints, and thereby the product having a good coating appearance can be obtained.

6. The inorganic composition and the electrodepositable composition used in the present invention are cold water coatings, and therefore the present product is favorable from the viewpoints of the safety and the prevention of pollution.

The present invention is illustrated by the following Examples but not limited thereto. In the Examples "part" means part by weight.

EXAMPLE 1

| [Inorganic Composition A] | |
|---|---|
| Sodium silicate (Grade number: 3) | 70 parts |
| Lithium polysilicate 48 (made by DuPont) | 30 parts |
| Titanium oxide | 30 parts |
| Kaolin | 106 parts |
| Demol N (trade name of Kao Soap Co.) | 2 parts |
| Water | 120 parts |

The above components are dispersed by a ball mill for 15 hours to give the desired inorganic composition.

| [Electrodepositable Composition B] | |
|---|---|
| Anhydrous trimellitic acid | 32 parts |
| Propylene glycol | 30 parts |
| Adipic acid | 8 parts |

The above components are reacted at 170° so that the acid value becomes 65, thereto is added tall oil aliphatic acid (30 parts) and the mixture is further reacted so that the acid value becomes 55. To the reaction mixture is added isobutanol (20 parts) and then the mixture is neutralized with triethylamine (12 parts). Into the resin thus obtained is suspended red iron oxide (35 parts) and then the mixture is diluted with water (1,000 parts) to give the desired electrodepositable composition.

After controlling the viscosity of the Inorganic Composition A by adding water (viscosity: 2 poise), the inorganic composition is applied to a mild steel panel which is degreased and treated with sandpaper to make the surface rough by dipping so that the thickness of the coating layer becomes about 30 $\mu$ in dry state, and then the resultant is dried by baking at 160° C for 15 minutes. The coated panel is dipped in Electrodepositable Composition B and then coated therewith by passing electric current at 200 volts for 3 minutes wherein the coated panel is used as the anode, and the resulting panel is rinsed with water and then cured by baking at 170° C for 30 minutes. The composite coating layer thus obtained has a thickness of about 50 $\mu$ and the intercoat adhesion is very good.

As Comparative Example 1, a mild steel panel coated with Inorganic Composition A is coated with a commercial melamine-alkyd paint by baking, the melamine-alkyd paint being prepared by dispersing Alkyd Resin Beckasol J 524 (made by Dainippon Ink & Chemicals Inc.; 50 parts), melamine resin (Super Beckamine G 821, trade name of Dainippon Inc & Chemicals Inc.; 17 parts), titanium oxide (27 parts), n-butyl alcohol (5 parts) and xylene (20 parts). The adhesion between the layers of the product thus obtained is inferior and the second (upper) coating layer crazes and is striped.

The properties of the coating layer in the products of the above Example 1 are compared with those of the coating layer obtained by coating Electrodepositable Composition B and the melamine-alkyd paint in the thickness of about 50 μ (Comparative Example 2). The results are shown in Table 1.

Table 1

| Name of the test | Method for the test | The product of Example 1 | The product of Comparative Example 2 |
|---|---|---|---|
| Folding test | Folded at right angle (Diameter: 10 mm) | Fine cracking<br>No peeling of the coating layer | Cracking |
| Impact test | DuPont method 300 g × 50 cm | Good | Cracking |
| | (Diameter: ½ inch) 500 g × 30 cm | Good | Cracking |
| Salt spray test | Tested by using Salt spray tester for 500 hours<br>Test piece is crosscut | Good<br>No rust on the cut part<br>No lowering of adhesion | Cut part is rusted in 5 mm in width<br>Adhesion lowers |
| Salt soak test | Test piece is soaked in 3 % saline solution for 1 month<br>Test piece is crosscut | Good<br>No rust on the cut part<br>No lowering of adhesion | Cut part is rusted and deep erosion is observed<br>Blistering<br>Lowering of adhesion particularly around the cut part |
| Warm water soak test | Test piece is soaked in tap water of 40° C for 1 month | A little blushing of the coating layer<br>No blistering | Blistering |
| Flame resistance test | Test piece is exposed on the flame of gas burner for 30 minutes | Inorganic coating layer is remained | Coating layer completely disappears |

EXAMPLE 2

| [Inorganic composition C] | |
|---|---|
| 30 % aqueous solution of potassium silicate having a molar ratio of $SiO_2 : K_2O$ being 3.5 | 80 parts |
| Colloidal silica (Snowtex 30, trade name of Nissan Chemical Industries, Ltd.) | 20 parts |
| Red iron oxide | 10 parts |
| Talc | 60 parts |
| Water | 50 parts |

The above components are dispersed in the same manner as in Example 1 and thereto is added a paste (5 parts) which is prepared by dispersing sodium silicofluoride (40 parts) into water (60 parts) to give the desired inorganic composition. [Electrodepositable composition D]

A mixture of an epoxy resin (Epikote 836, trade name of Shell International Research Mant.; 200 parts), methanol (55 parts), stannous chloride (2.5 parts) and diethylene glycol (28 parts) is reacted at 150° C for 3 hours to give a product X. Separately, a mixture of N,N-diethylethanolamine (742 parts), lactic acid (714 parts) of toluene (300 parts) is subjected to dehydration reaction at 110° C for 4 hours and to the reaction mixture is added boron oxide (245 parts) and neopentyl glycol (728 parts), and then the mixture is further subjected to dehydration reaction at 120° C for 4 hours to give a product Y. To the product X (200 parts) is added the product Y (13 parts) at 70° C over a period of 30 minutes with agitation. To the resulting solution are added formic acid and deionized water (1900 parts) to regulate the pH value to 4.5, and thereto is further added a paste prepared by dispersing titanium oxide (100 parts) into melamine resin (Cymel 300, trade name of Union Carbide Corp.; 40 parts) and water (60 parts) to give the desired electrodepositable composition.

The Inorganic Composition C obtained above is applied to a stainless steel panel, an aluminum panel and a galvanized mild steel panel by using an electrostatic spraying machine (Nakaya type) so that the thickness of the coating layer becomes about 10 μ in dry state, and then the resultant is dried at 120° C for 10 minutes. Each coated panel is subjected to an electrodeposition coating with Electrodepositable Composition D at 200 volts for 2 minutes wherein the coated panel is used as the anode, and then the resulting panel is baked at 180° C for 20 minutes to give a composite coating layer having a thickness of about 30 μ and having smooth surface. All coated panels, i.e. the stainless steel panel, aluminum panel and mild steel panel have excellent inter-coat adhesion.

As Comparative Examples 3 and 4, the panels coated with Inorganic Composition C is coated with an acrylic resin paint comprising an acrylic resin (Rustrazole A 405, trade name of Dainippon Ink & Chemicals Inc.; 35 parts) a melamine resin (Super Beckamine J 820, trade name Dainippon Ink & Chemicals Inc.; 16 parts), titanium oxide (25 parts), xylene (25 parts), butyl alcohol (5 parts) and butyl acetate (5 parts) by baking or with an epoxy enamel paint which is prepared by mixing a paste comprising an epoxy resin (Epikote 1001, trade name of Shell International Research Mant.; 22 parts), titanium oxide (28 parts), xylene (15 parts), methyl isobutyl ketone (5 parts) and ethyl cellosolve (7 parts) with an amide resin (Lacquamide ODG-44, trade name of Dainippon Ink & Chemicals Inc.; 9 parts), and then dried. The composite coating layers have inferior adhesion and are peeled off by peeling test using Scotch brand cellophane tape.

The properties of the coating layer in the products of the above Example 2 by using a galvanized mild steel panel and an aluminum panel are compared with those of the coating layer in the products (thickness of the coating layer; about 30 μ), which are obtained by applying a thermosetting type acrylic paint crosslinked with a melamine to a galvanized mild steel panel (Comparative Example 5) and an aluminum panel (Comparative Example 6), which are first coated with Electrodepositable Composition D.

The results are shown in Table 2.

Table 2

| Name of the test | Method for the test | Galvanized mild steel panel: The product of Example 2 | Galvanized mild steel panel: The product of Comparative Example 5 | Aluminum panel: The product of Example 2 | Aluminum panel: The product of Comparative Example 6 |
|---|---|---|---|---|---|
| Folding test | In the same manner as in Example 1 | Fine cracking | Cracking | Fine cracking | Cracking |
| Impact test | DuPont method (Diameter: ½ inch) 300 g × 50 cm | Good | Dry spot of the coating layer | Good | Cracking |
| | 500 g × 30 cm | Cracking | Many cracking | Cracking | — |
| Salt spray test | In the same manner as in Example 1 | Good Rust on the cut part | Blistering and rust along the cut part | Good | Blistering of all part |
| Salt soak test | In the same manner as in Example 1 | Good | Blistering | Good | Much blistering |
| Flame resistance test | In the same manner as in Example 1 | Inorganic coating layer is remained | Coating layer disappears | Inorganic coating layer is remained | Coating layer disappears |

EXAMPLE 3

[Inorganic Composition E]

The inorganic Composition C (100 parts) used in Example 2 is admixed with a resin emulsion (Nikasol A-08, trade name of Nippon Carbide Industries Co., Inc.; 3 parts) to give the desired inorganic composition.

The Inorganic Composition E is applied to a degreased steel panel by an electrostatic spraying machine (Nakaya type) so that the thickness of the coating layer becomes about 10 μ in a dry state, and then the resultant is dried at 120° C for 10 minutes. To the coated panel is applied the Electrodepositable Composition D in the same manner as in Example 2, and the resulting panel is dried at 180° C for 20 minutes to give a composite coating layer having a thickness of about 30 μ.

The properties of the coating layer of the product thus obtained are compared with those of the product (Comparative Example 7), which is produced by applying Inorganic Composition C and Electrodepositable Composition D to a degreased steel panel in the same manner as in Example 2. The results are shown in Table 3.

Table 3

| Name of the test | Method for the test | The product of Example 3 | The product of Comparative Example 7 |
|---|---|---|---|
| Folding test | In the same manner as in Example 1 | Good | Fine cracking |
| Impact test | DuPont method (Diameter: ½ inch) 500 g × 50 cm | Good | Cracking |
| Salt spray test | In the same manner as in Example 1 | Good | Good |

As made clear from the above results, the properties of the composite coating layer, e.g. the flexibility can be improved by admixing a small amount of an organic resin.

EXAMPLE 4

[Inorganic Composition F]

A lithium silicate (Lithium Silicate 75, made by Nissan Chemicals Industries, Ltd.; 70 parts), a colloidal silica (Snowtex 20, trade name of Nissan Chemicals Industries, Ltd.; 30 parts) and water (100 parts) are mixed to give the desired inorganic composition.

[Electrodepositable Composition G]

A mixture of methyl methacrylate (30 parts), ethyl acrylate (25 parts), n-butyl acrylate (30 parts), 2-hydroxy-n-propyl acrylate (10 parts), methacrylic acid (6 parts) and benzoyl peroxide (1 part) is added dropwise to a mixed solvent of butyl cellosolve (30 parts) and n-butyl alcohol (20 parts) at 130° C over a period of 4 hours to give a resinous product. The product (61 parts) is partially neutralized by adding deionized water (75 parts) and diethylamine (2 parts) and thereto are added a melamine resin (Cymel 300, trade name of Monsanto Chemicals Ltd.; 21 parts), deionized water (18 parts) and diethylamine (7 parts), and the resulting mixture is diluted with deionized water so that the non-volatile solid content become 12% by weight to give the desired electrodepositable composition.

A mild steel panel which is degreased and treated with sandpaper to make the surface rough is dipped in Inorganic Composition F wherein the steel panel is used as the cathode, and then coated therewith by passing an electric current at 10 volts for 10 seconds, by which the inorganic composition is coated to a thickness of about 2 to 3 μ. After rinsing with water, the coated panel thus obtained is dipped in Electrodepositable Composition G wherein the steel panel is used as the cathode, and then coated therewith by passing electric current at 80 volts for 3 minutes. The resulting panel is rinsed with water and then baked at 190° C for 20 minutes to give a composite coating layer having a thickness of about 20 μ.

The properties of the coating layer of the product obtained above are compared with those of the product having a thickness of about 20 μ (Comparative Example 8), which is produced by electrodeposition coating the same mild steel panel as used above with Electrodepositable Composition G. The results are shown in Table 4.

Table 4

| Name of the test | Method for the test | Example 4 | The product of Comparative Example 8 |
|---|---|---|---|
| Hardness of coating layer | By pencil hardness test | F - H | HB |
| Impact test | DuPont method (Diameter: ½ inch) 500 g × 30 cm | Good | Good |
| Salt spray test | Tested by using Salt spray tester for 200 hours | A little lowering of adhesion No rust | Tends to dry spot Lowering of adhesion |

Table 4-continued

| Name of the test | Method for the test | Example 4 | The product of Comparative Example 8 |
|---|---|---|---|
| | | | Spot rusts |

EXAMPLE 5

| [Inorganic Composition H] | |
|---|---|
| 50 % aqueous solution of monobasic magnesium phosphate | 10 parts |
| 50 % aqueous solution of monobasic aluminum phosphate | 10 parts |
| Water | 80 parts |

The above components are mixed to give the desired inorganic composition.

A defatted mild steel panel is coated with Inorganic Composition H by dipping therein at 40° C. The coated panel is allowed to stand for 15 minutes and then dried at 150° C for 15 minutes to give a coated panel having an inorganic coating layer of about 2 to 3 μ in thickness. The coated panel is electrically deposited with Electrodepositable Composition B used in Example 1 at 220 volts for 2 minutes, and then baked at 180° C for 30 minutes to give a composite coating layer having a thickness of about 20 μ.

The properties of the coating layer of the product thus obtained are similar to those of the product which is produced by electrodeposition coating a mild steel panel subjected to chemical treatment with zinc phosphate by using Electrodepositable Composition B and further are superior to those of the product which is produced by electrodeposition coating a mild steel panel subjected to chemical treatment with iron phosphate by using Electrodepositable Composition B.

The product obtained in Example 5 does not contain any heavy metal and therefore has extremely smaller danger of water pollution in comparison with that subjected to chemical treatment with zinc phosphate.

EXAMPLE 6

| [Inorganic Composition I] | |
|---|---|
| 50 % aqueous solution of monobasic aluminum phosphate | 70 parts |
| Silica phosphate (Corrosinon SPO-28, trade name of Mizusawa Chemical Co.) | 65 parts |
| Water | 70 parts |

The above components are dispersed in the same manner as in Example 1, and to the resulting paste (100 parts) is added a paste (10 parts) which is prepared by dispersing barium fluoroborate (40 parts) in water (60 parts) to give the desired inorganic composition.

[Electrodepositable Composition J]

To the Electrodepositable Composition G used in Example 4 is dispersed titanium oxide so that the ratio of the non-volatile components contained in the composition to titanium oxide becomes 3 : 1 by weight to give the desired electrodepositable composition.

The Inorganic Composition I is applied to a degreased mild steel panel by air spraying so that the thickness of the coating layer becomes 6 to 8 μ in dry state, and the resultant is baked at 180° C for 10 minutes. The coated panel is subjected to an electrodeposition coating with Electrodepositable Composition J at 150 volts for 2 minutes in the same manner as in Example 1, and the resulting panel is rinsed with water and baked at 180° C for 30 minutes to give a composite coating layer having a thickness of about 30 μ.

The properties of the coating layer of the product thus obtained are compared with those of the product (thickness of the layer: 30 μ) (Comparative Example 9), which is produced by applying Electrodepositable Composition J to a mild steel panel which is subjected to chemical treatment with zinc phosphate. The results are shown in Table 5.

Table 5

| Name of the test | Method for the test | The product of Example 6 | The product of Comparative Example 9 |
|---|---|---|---|
| State of coating layer | By gross investigation | Highly white in comparison with the Comparative Example 9 Good | Somewhat coloring |
| Impact test | DuPont method (Diameter: ½ inch) 500 g × 30 cm | Good | Good |
| Salt spray test | Tested by using Salt spray tester for 250 hours | Good | Inferior adhesion in the width of 10 mm along the cut part |
| Folding test | In the same manner as in Example 1 | Fine cracking | Good |

EXAMPLE 7

[Inorganic Composition K]

To the Inorganic Composition I (100 parts) used in Example 6 is added a water-soluble melamine (Cymel 300, trade name of Monsanto Chemicals Ltd.; 3 parts) to give the desired inorganic composition.

In the same manner as in Example 6, the Inorganic Composition K is applied to a degreased mild steel panel and the resultant is baked. The coated panel is subjected to the electrodeposition coating with Electrodepositable Composition J and then baked to give a composite coating layer having a thickness of about 30 μ.

In comparison of the properties of the coating layer of the product obtained above with those of the product in Example 6, the product of the present Example 7 is similar to the latter in the salt spray test, but is superior in the impact test and folding test. This means that the product of the present Example 7 has improved fabrication performance.

EXAMPLE 8

| [Inorganic Composition L] | |
|---|---|
| Monobasic zinc phosphate | 60 parts |
| Aluminum tertiary phosphate | 15 parts |
| Kaolin | 15 parts |
| Ground serpentine | 10 parts |
| Water | 170 parts |

The above components are dispersed by a degreased mixer (Red Devil type) using alumina bead for 30 minutes to give the desired inorganic composition.

The Inorganic Composition L is applied to a degreased mild steel panel by using an electrostatic spraying machine (Nakaya type) so that the thickness of the coating layer becomes 20 μ, and the resultant is baked at 160° C for 20 minutes. The coated panel thus obtained is subjected to the electrodeposition coating with Electrodepositable Composition B used in Example 1 at 200 volts for 2 minutes, and the resultant is baked at 170° C for 30 minutes to give a composite coating layer having a thickness of about 35 μ. The properties of the coating layer of the product thus obtained are shown in Table 6.

Table 6

| Name of the test | Method for the test | Result of the test |
|---|---|---|
| Folding test | In the same manner as in Example 1 | Good |
| Impact test | DuPont method (Diameter: 500 g × 40 cm ½ inch) | Good |
| Salt spray test | In the same manner as in Example 1 | Good |
| Warm water soak test | In the same manner as in Example 1 | Good |

EXAMPLE 9

| [Inorganic Composition M] | |
|---|---|
| 50% aqueous solution of monobasic aluminum phosphate | 100 parts |
| Zinc secondary phosphate | 10 parts |
| HB Hardner (made by Farbwerke Hoechst A.G.) | 50 parts |
| Powdery silica | 20 parts |
| Kaolin | 40 parts |
| Water | 120 parts |

These components are dispersed in the same manner as in Example 1 to give the desired inorganic composition.

| [Electrodepositable Composition N] | |
|---|---|
| Linseed oil | 90 parts |
| Maleic anhydride | 10 parts |

The mixture of the above components are heated at 200° C for 2 hours to give linseel oil maleate, and to the resultant are added styrene (30 parts) and di-t-butyl peroxide (2 parts) and the mixture is reacted at 140° C for 2 hours. The reaction mixture is diluted with butyl cellosolve (30 parts) and then neutralized with triethylamine (45 parts) and water (50 parts) and thereby the product is made water-soluble. In the mixture is dispersed red iron oxide (50 parts) and then the mixture is diluted with water (2,000 parts) to give the desired electrodepositable composition.

To a mild steel panel which is subjected to chemical treatment with zinc phosphate is applied Inorganic Composition M by air spraying, and the resultant is baked at 200° C for 30 minutes to give a panel having inorganic coating layer of 70 μ in thickness. The coated panel is then subjected to the electrodeposition coating with Electrodepositable Composition N at 250 volts for 3 minutes in the same manner as in Example 1, and the resultant is baked at 170° C for 20 minutes to give a composite coating layer having a thickness of 90 μ and having excellent inter-coat adhesion.

The properties of the coating layer of the product thus obtained is compared with those of the product (Comparative Example 10), which is produced by applying a thermosetting type acrylic resin paint cross-linked with a melamine to a mild steel panel which is electrically coated with Electrodepositable Composition N. The results are shown in Table 7.

Table 7

| Name of the test | Method for the test | The product of Example 9 | The product of Comparative Example 10 |
|---|---|---|---|
| Folding test | In the same manner as in Example 1 | Fine cracking<br>No peeling | Long cracking |
| Impact test | DuPont method (Diameter: ½ inch) 300 g × 50 cm | Good | Cracking |
| | 500 g × 30 cm | Good | Cracking |
| Salt spray test | In the same manner as in Example 1 | Good<br>No deep erosion of cut part | Cut part is rusted in 4 mm in width and Blistering is observed |
| Salt soak test | In the same manner as in Example 1 | Good<br>No deep erosion of cut part | Blistering along the the cut part |
| Warm water soak test | In the same manner as in Example 1 | Organic coating layer is rather expansive | Blistering |
| Flame resistance test | In the same manner as in Example 1 | Inorganic coating layer is remained | Coating layer completely disappears |

EXAMPLE 10

The Inorganic Composition M used in Example 9 is applied to a degreased mild steel panel by air spraying so that the weight of the dried coating layer is about 30 g/m², and the resultant is baked at 200° C for 15 minutes. The coated panel is then subjected to the electrodeposition coating with Electrodepositable Composition G used in Example 4 at 120 volts for 5 seconds, and the resultant is baked at 190° C for 20 minutes to give a composite coating layer. The composite coating layer thus formed has a weight of about 35 g/m² in dry state and comprises predominantly inorganic components.

The properties of the coating layer of the product thus obtained are compared with those of the product coated with only the inorganic composition. The results are shown in Table 8.

Table 8

| Name of the test | Method for the test | Inorganic coating layer | Composite coating layer |
|---|---|---|---|
| Impact test | DuPont method (Diameter: ½ inch) 500 g × 30 cm | Cracking | Good |
| Salt spray test | Tested by using Salt spray tester for 100 hours | Rust | Good |

As made clear from the above results, when the panel is applied with only the inorganic composition, the coating layer is inferior in the flexibility and corrosion resistance, but by combining an electrodepositable composition layer, the properties are extremely improved.

EXAMPLE 11

| [Inorganic Composition O] | |
|---|---|
| Inorganic Composition M used in Example 9 | 100 parts |
| Graphite (Sheest SO, trade name of | |

-continued

| | |
|---|---|
| Tokai Electrode Mfg. Co., Ltd.) | 5 parts |
| Surface active agent (Pelex OTP, trade name of Kao Soap K.K.) | 1 part |
| Water | 15 parts |

The above components are mixed to give the desired inorganic composition.

The Inorganic Composition O is applied to a degreased mild steel panel and aluminum panel by air spraying so that the thickness of the coating layer becomes 180 μ in the dry state, and the resultant is baked at 200° C for 60 minutes. The coated panel is then subjected to the electrodeposition coating with Electrodepositable Composition N used in Example 9 at 250 volts for 3 minutes, and the resultant is rinsed with water and baked at 170° C for 20 minutes to give a composite coating layer having a thickness of about 200 μ. Both the coated mild steel panel and aluminum panel show excellent inter-coat adhesion and the thick coating layer has smooth surface.

EXAMPLE 12

| [Inorganic Composition P] | |
|---|---|
| Monobasic calcium phosphate | 60 parts |
| Zinc oxide | 10 parts |
| Kaolin | 30 parts |
| Water | 120 parts |

The above components are mixed and the mixture is agitated to give the desired inorganic composition.

| [Electrodepositable Composition Q] | |
|---|---|
| Epoxy resin (Epikote 1001, trade name of Shell International Research Mant.) | 40 parts |
| Dehydrated castor oil fatty acid | 26 parts |
| Rosin | 10 parts |
| Fatty acid dimer | 18 parts |
| Xylene | 6 parts |

The mixture of the above components is subjected to dehydration reaction at 200° C for 2 hours. The reaction product is diluted with butyl alcohol (20 parts) and neutralized with 10% aqueus ammonia (100 parts). In the mixture is dispersed red iron oxide (30 parts), and then the mixture is diluted with water (1,100 parts) to give the desired electrodepositable composition.

The Inorganic Composition P is applied to an aluminum panel by brushing so that the thickness of the coating layer becomes about 10 μ, and the resultant is dried at room temperature for 24 hours. The coated panel thus obtained is subjected to an electrodeposition coating with Electrodepositable Composition Q at 200 volts for 2 minutes in the same manner as in Example 1, and the resultant is baked at 170° C for 20 minutes to give a composite coating layer having a thickness of about 30 μ and having excellent inter-coat adhesion.

The properties of the coating layer of the product thus obtained are compared with those of the product (Comparative Example 11), which is produced by applying a thermosetting type acrylic resin paint cross-linked with a melamine used in Example 2 to an aluminum panel. The results are shown in Table 9.

Table 9

| Name of the test | Method for the test | The product of Example 12 | The product of Comparative Example 11 |
|---|---|---|---|
| Folding test | In the same manner as in Example 1 | Fine cracking<br>No peeling of the coating layer | Long cracking |
| Impact test | DuPont method (Diameter: ½ inch) 300 g × 50 cm | Good | Coating layer of the impacted part tends to dry spot |
| | 500 g × 30 cm | Good | Peeling |
| Salt spray test | Tested by using Salt spray tester for 300 hours | Good | Coating layer tends to dry spot<br>Significant lowering of adhesion |
| Warm water soak test | Test piece is soaked in tap water of 40° C for 15 days | Organic coating layer is rather expansive | Dry spot and peeling of coating layer |

EXAMPLE 13

| [Inorganic Composition R] | |
|---|---|
| Aluminum metaphosphate (B type) | 80 parts |
| 30 % aqueous solution of potassium silicate having a molar ratio of $SiO_2 : K_2O$ being 3.5 | 70 parts |
| Water | 150 parts |

The above components are dispersed by a dispersion mixer (Red Devil type) using alumina bead for 30 minutes to give the desired inorganic composition.

The Inorganic Composition R is applied to a galvanized mild steel panel by air spraying so that the thickness of the coating layer becomes 15 μ, and the resultant is dried at 140° C for 20 minutes. The coated panel is dipped in Electrodepositable Composition Q used in Example 12 and then subjected to the electrodeposition coating at 200 volts for 2 minutes, and the resultant is baked at 170° C for 20 minutes to give a composite coating layer having a thickness of about 30 μ and having excellent inter-coat adhesion.

As Comparative Examples 12 and 13, to a galvanized mild steel panel and the panel which is coated with Inorganic Composition R in a thickness of 15 μ is applied the Electrodepositable Composition Q without dilution with water by spray coating so that the thickness of the coating layer becomes 15 μ, and the resultants are baked at 170° for 20 minutes. The coating layers thus formed have extremely inferior adhesion in comparison with that of the present Example 13.

EXAMPLE 14

| [Inorganic Composition S] | |
|---|---|
| Colloidal silica (Snowtex O, trade name of Nissan Chemical Industries, Ltd.) | 10 parts |
| 50 % aqueous solution of monobasic aluminum phosphate | 15 parts |
| Water | 55 parts |

The above components are mixed to give the desired inorganic composition.

The Inorganic Composition S is applied to a degreased mild steel panel by dipping, and the resultant is dried at 100° C for 10 minutes to give a panel having an inorganic coating layer of 3 to 5 μ in thickness in dry state. The coated panel is dipped in Electrodepositable Composition N used in Example 9 and then subjected to the electrodeposition coating at 200 volts for 3 minutes, and the resultant is baked at 170° C for 30 minutes to give a composite coating layer having a thickness of about 22 μ.

The properties of the coating layer of the product thus obtained are compared with those of the product (thickness of the coating layer: about 20 μ) (Comparative Example 14), which is produced by the electrodeposition coating of a mild steel panel subjected to chemical treatment with zinc phosphate by using Electrodepositable Composition N. The results are shown in Table 10.

Table 10

| Name of the test | Method for the test | The product of Example 14 | The product of Comparative Example 14 |
|---|---|---|---|
| Folding test | In the same manner as in Example 1 | Good | Good |
| Impact test | DuPont method (Diameter: ½ inch) 500 g × 50 cm | Good | Good |
| Salt spray test | In the same manner as in Example 1 | Lowering of adhesion along the cut part in 2 mm in width | Lowering of adhesion along the cut part in 10 mm in width |

EXAMPLE 15

[Inorganic Composition T]

Monobasic aluminum phosphate (70 parts) is mixed with water (30 parts) and the mixture is heated at 200° C for 2 hours under evaporating water. The resulting semi-solid material is roughly ground. The resultant is calcined at 450° C for 5 hours and then pulverized to give a calcined aluminum phosphate. To the Inorganic Composition A (100 parts) used in Example 1 is added a paste (15 parts), which is prepared by dispersing the calcined aluminum phosphate (40 parts) obtained above in water (60 parts), and thereby the desired Inorganic Composition T is obtained.

The Inorganic Composition T thus obtained is applied to a mild steel panel which is degreased and treated with sandpaper to make the surface rough by spray coating so that the thickness of the coating layer becomes about 40 μ, and the resultant is dried at 120° C for 20 minutes. The coated panel is subjected to an electrodeposition coating with Electrodepositable Composition B in the same manner as in Example 1, and the resultant is baked at 170° C for 30 minutes to give a composite coating layer having a thickness of about 60 μ and having excellent adhesion between the layers.

The properties of the coating layer of the product obtained above is similar to the product of Example 1 in the folding test and impact test, but in the salt spray test, the product of the present Example 15 shows extremely less rust in the cross-cut part, which means the product of the present Example 15 has superior corrosion resistance to that of the Example 1. The test results are shown in Table 11.

Table 11

| Name of the test | Method for the test | Result of the test |
|---|---|---|
| Folding test | In the same manner as in Example 1 | Fine cracking<br>No peeling of the coating layer |
| Impact test | DuPont method (Diameter: ½ inch) 500 g × 30 cm | Good |
| Salt spray test | In the same manner as in Example 1 | Good<br>Rust of the cut part is less than Example 1<br>No lowering of adhesion |
| Salt soak test | In the same manner as in Example 1 | Good<br>Rust of the cut part is less than Example 1<br>No lowering of adhesion |
| Warm water soak test | In the same manner as in Example 1 | A little blushing of the coating layer<br>No blistering |

What is claimed is:

1. A method for coating a conductive material, which consists essentially of physically coating a conductive material with an inorganic composition which is substantially non-chemically reactive to the substrate, said inorganic composition containing at least a monobasic aluminum phosphate to form an inorganic coating layer and then applying thereto an organic electrodepositable composition by electrophoretic means to form an organic coating layer.

2. The method according to claim 1, wherein the inorganic composition consists essentially of monobasic aluminum phosphate, at least one of other metal phosphates selected from the group consisting of monobasic magnesium phosphate, monobasic zinc phosphate, monobasic calcium phosphate, a sesqui, secondary or tertiary salt of the aluminum, magnesium, zinc or calcium phosphate, a polyphosphate and a calcined metal phosphate, and a diluent.

3. The method according to claim 2, wherein the inorganic composition is coated in an amount of 0.5 to 15 g/m² as a solid component.

4. The method according to claim 3, wherein the inorganic composition is coated in an amount of 1 to 8 g/m².

5. The method according to claim 1, wherein the inorganic composition consists essentially of monobasic aluminum phosphate, at least one of other phosphates selected from the group consisting of monobasic magnesium phosphate, monobasic zinc phosphate, monobasic calcium phosphate, a sesqui, secondary or tertiary salt of the aluminum, magnesium, zinc or calcium phosphate, a polyphosphate and a calcined metal phosphate, at least one of other additives selected from the group consisting of titanium oxide, red iron oxide, zinc oxide, kaolin, clay, talc and powdery or colloidal silica, and a diluent.

6. The method according to claim 5, wherein the inorganic composition is coated in an amount of 1 to 80 g/m² as a solid component.

7. The method according to claim 6, wherein the inorganic composition is coated in an amount of 5 to 50 g/m².

8. The method according to claim 7, wherein the inorganic composition is coated in an amount of 10 to 30 g/m².

9. The method according to claim 1, wherein the inorganic composition consists essentially of monobasic aluminum phosphate, at least one of other additives selected from the group consisting of titanium oxide, red iron oxide, zinc oxide, kaolin, clay, talc and powdery or colloidal silica, and a diluent.

10. The method according to claim 9, wherein the inorganic composition is coated in an amount of 1 to 80 $g/m^2$ as a solid component.

11. The method according to claim 10, wherein the inorganic composition is coated in an amount of 5 to 50 $g/m^2$.

12. The method according to claim 11, wherein the inorganic composition is coated in an amount of 10 to 30 $g/m^2$.

13. The method according to claim 1, wherein the organic electrodepositable composition is a member selected from the group consisting of an anionic electrodepositable composition and a cationic electrodepositable composition.

14. The method according to claim 13, wherein the anionic electrodepositable composition comprises a resin selected from the group consisting of a reaction product of an aliphatic ester and an $\alpha,\beta$-unsaturated dicarboxylic acid or its anhydride, a reaction product of a polyol with a reaction product of an aliphatic ester and an $\alpha,\beta$-unsaturated dicarboxylated acid or its anhydride, a mixed resin comprising a copolymer resin having carboxyl groups and an amine-aldehyde condensation product, and a mixed resin comprising an alkyd resin having a high acid value and an amine-aldehyde condensation product, said resin being neutralized with an organic base or an inorganic base.

15. The method according to claim 13, wherein the cationic electrodepositable composition comprises a resin selected from the group consisting of a reaction product of an epoxy compound with an amine salt, and a resin containing a quaternary amine sait residue.

16. The method according to claim 1, wherein the application of the organic electrodepositable composition to the conductive material coated with the inorganic composition is carried out by dipping the conductive material in the organic electrodepositable composition and thereafter passing an electric current at an applied voltage of 10 to 500 volts for 1 second to 10 minutes.

* * * * *